United States Patent [19]

Bulso, Jr. et al.

[11] Patent Number: 4,716,755

[45] Date of Patent: Jan. 5, 1988

[54] METHOD AND APPARATUS FOR FORMING CONTAINER END PANELS

[75] Inventors: Joseph D. Bulso, Jr., Canton; James A. McClung, North Canton, both of Ohio

[73] Assignee: Redicon Corporation, Canton, Ohio

[21] Appl. No.: 889,945

[22] Filed: Jul. 28, 1986

[51] Int. Cl.[4] ..... B21D 22/00

[52] U.S. Cl. ..... 72/349; 72/354; 72/379; 413/8; 413/56

[58] Field of Search ..... 72/348, 350, 351, 353, 72/354, 379, 329; 413/8, 56, 62

[56] References Cited

U.S. PATENT DOCUMENTS

| | | | |
|---|---|---|---|
| 3,537,291 | 10/1967 | Hawkins | 72/336 |
| 3,957,005 | 5/1976 | Heffner | 72/348 |
| 4,031,837 | 6/1977 | Jordan | 113/121 |
| 4,054,228 | 10/1977 | Balocca et al. | 220/268 |
| 4,093,102 | 6/1978 | Kraska | 220/67 |
| 4,109,599 | 8/1978 | Bulso, Jr. et al. | 271/269 |
| 4,516,420 | 5/1985 | Bulso, Jr. et al. | 72/329 |
| 4,549,424 | 10/1985 | Bulso, Jr. et al. | 72/329 |
| 4,567,746 | 2/1986 | Bachmann et al. | 413/56 |
| 4,571,978 | 2/1986 | Taube et al. | 72/354 |
| 4,587,826 | 5/1986 | Bulso, Jr. et al. | 413/56 |
| 4,641,761 | 2/1987 | Smith et al. | 413/8 |

*Primary Examiner*—Robert L. Spruill
*Assistant Examiner*—Donald R. Studebaker
*Attorney, Agent, or Firm*—Reese Taylor

[57] ABSTRACT

A method of forming a container end piece includes blanking a work piece from a sheet of material and forming an inverted cup therefrom by wiping the peripheral edge of the blank over a die core ring. The inverted cup is then reversed by advancing a punch core and a punch core ring simultaneously to form a cup having a flange area, a central body area and a chuckwall area interconnecting the flange and the bottom. The punch core ring is then advanced ahead of the punch core to shorten the chuckwall area and reduce the radius between the chuckwall and the central bottom portion. The method also includes engaging the flange area of the reversed cup by a pressure sleeve which moves downwardly with the punch core ring during the final forming of the chuckwall. The apparatus includes a press having a fixed base and movable platen wherein a punch shell is carried by the movable platen and a punch core ring is carried by the fixed base so that upon movement of the punch shell toward the fixed base, the peripheral edge of the blank is wiped over the die core ring to form the inverted cup. The punch core and punch core ring are also carried by the movable platen, with the punch core being air loaded so that the relationship between the punch core and punch core ring can be maintained during a portion of the travel, namely throughout the inversion of the reversed cup but so that the punch core ring can be advanced beyond the punch core to shorten the chuckwall area of the cup and tighten the radius of the chuckwall.

6 Claims, 7 Drawing Figures

METHOD AND APPARATUS FOR FORMING CONTAINER END PANELS

FIELD OF THE INVENTION

This invention relates, in general, to forming end panels or closures for two piece or three piece containers from a blank of metal and relates in particular to a method and apparatus for forming such end panels in double acting presses with the resulting product having an improved strengthened chuckwall area formed without unacceptable thinning of the metal during forming.

DESCRIPTION OF THE PRIOR ART

End panels for two piece or, for that matter, three piece metal containers are well known in the art. Examples of various end panels of this general type and of methods for forming them can be seen in Hawkins U.S. Pat. No. 3,537,291; Jordan U.S. Pat. No. 4,031,837; Balocca U.S. Pat. No. 4,054,228; Kraska U.S. Pat. No. 4,093,102; Schultz U.S. Pat. No. 4,109,599; Bulso U.S. Pat. No. 4,516,420; and Bulso U.S. Pat. No. 4,549,242.

Particularly in the beer and beverage industries where the contents are packaged under pressure, certain contours, commonly known as the chuckwall, are formed in these end panels to impart the strength necessary for them to withstand these internal pressures. It is of major importance in forming these end panels to control the thickness of the metal during the forming operation while providing adequate strength in the critical chuckwall area of the panel.

In this industry, there is also constant stress on reducing starting metal thickness. Reduction of one thousandth of an inch in the gauge of the starting metal can produce phenomenal savings over the course of a production year in view of the tremendous quantities of these pieces produced.

Nevertheless, while it is, of course, desirable to achieve this metal reduction for economic reasons, certain problems are commonly encountered when this is attempted.

Specifically, as noted, these end panels are contoured and have what is usually called a chuckwall formed in them. These chuckwalls are essentially annular and include vertical wall surfaces which extend downwardly from adjacent the peripheral edge of the panel and then upwardly to the main body portion of the panel with the walls being joined at the bottom by a radiused area. In essence, it can be said that the tighter the radius, the better the chuckwall and the stronger the end panel. However, with the constant pressure for reduction in starting gauge of the material, the material becomes harder and thinner and more and more difficult to draw in conventional draw and redraw equipment to the required or desired small radius without destruction of the article due to the stress created by drawing the metal about a sharply radiused tool.

The obvious solution to the problem created in the forming of such a tight radius is to start with thicker material so that, when the panel is thinned during forming, sufficient thickness remains in the finished product. Unfortunately, this defeats the object of achieving economy by reducing starting thickness and also results in too much or unnecessary metal thickness in some other areas where it is not needed.

Attempts to resolve this problem have been made in various ways, primarily by producing the end panel in a forming and reforming operation normally accomplished in successive stations in the press so as to avoid a single drastic draw over a sharp radius. Such a draw, with very thin, hard metal, can result in metal failure.

Therefore, it is felt that if this could be accomplished in a single station with a single hit or draw, considerable savings can be accomplished in the manufacturing operation while providing the desired stability and strength in the chuckwall area and achieving only the desired reduction in the thickness of the starting material.

SUMMARY OF THE INVENTION

It has therefore been found that considerable reduction in the starting gauge without detracting from the strength of the finished product can be achieved by initially forming an overlength chuckwall with an enlarged radius and then reforming it at the same station without further drawing.

To that end, it has been found that utilization of a punch assembly having a punch core ring movable with one press slide and an air loaded punch core, carried by the same slide and removable relatively of the punch core ring makes it possible to initialy form the chuckwall and an oversized radius by the combined movement of the punch core and punch core ring toward a die core and die core ring.

It is then possible, by further moving the punch core ring relatively of the punch core while holding the punch core in contact with the center panel of the end piece, to reform the chuckwall and chuckwall radius.

Accordingly production of an improved method and apparatus for forming and reforming end panels of the character above described becomes the principal object of this invention with other objects thereof becoming more apparent upon a reading of the following brief specification considered and interpreted in view of the accompanying drawings.

OF THE DRAWINGS

BRIEF DESCRIPTION OF THE PREFERRED EMBODIMENTS

Figure 1:
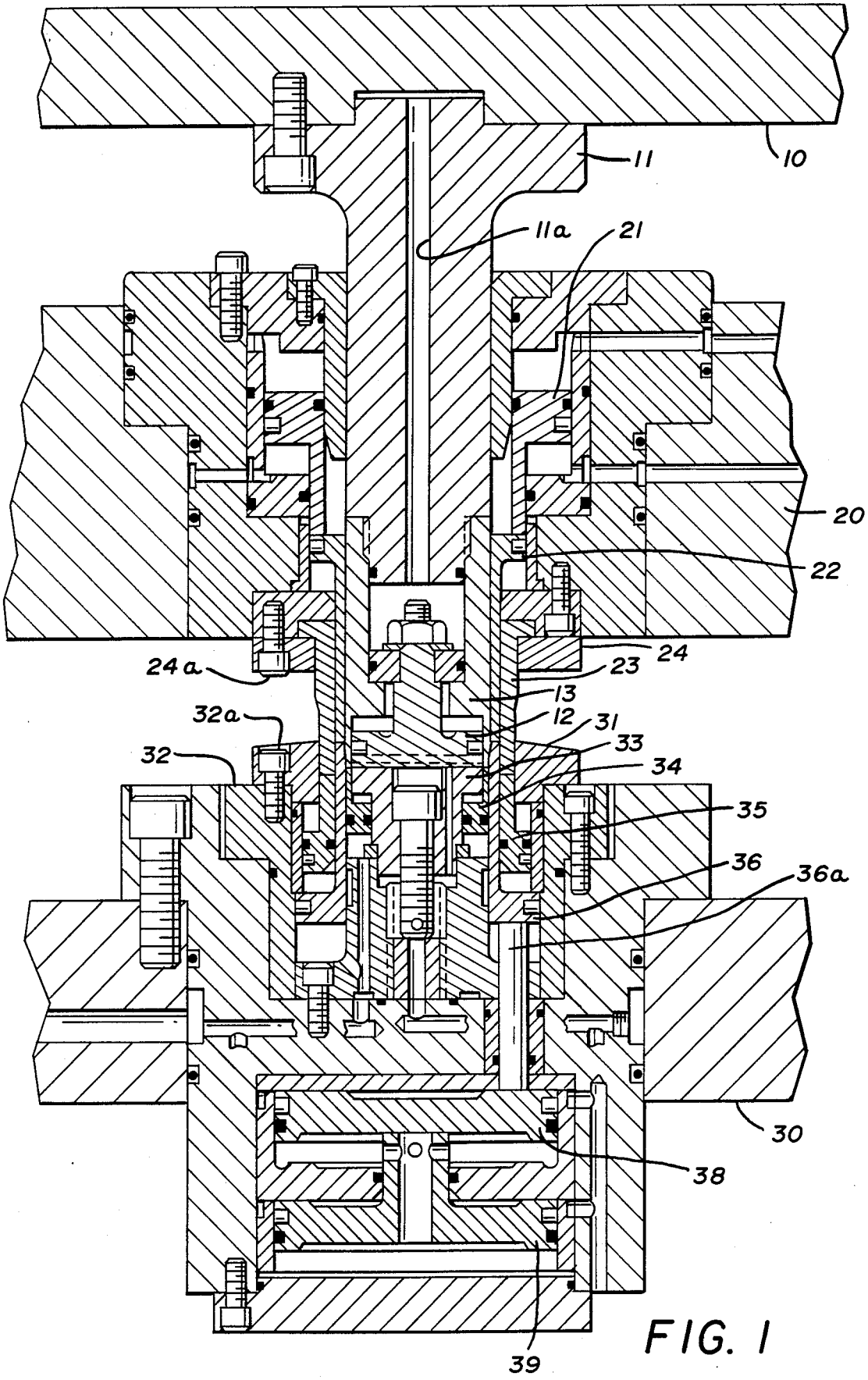
FIG. 1 is an elevational assembly view partially in section showing the position of the tooling following initial forming of the end piece.
Figure 2:
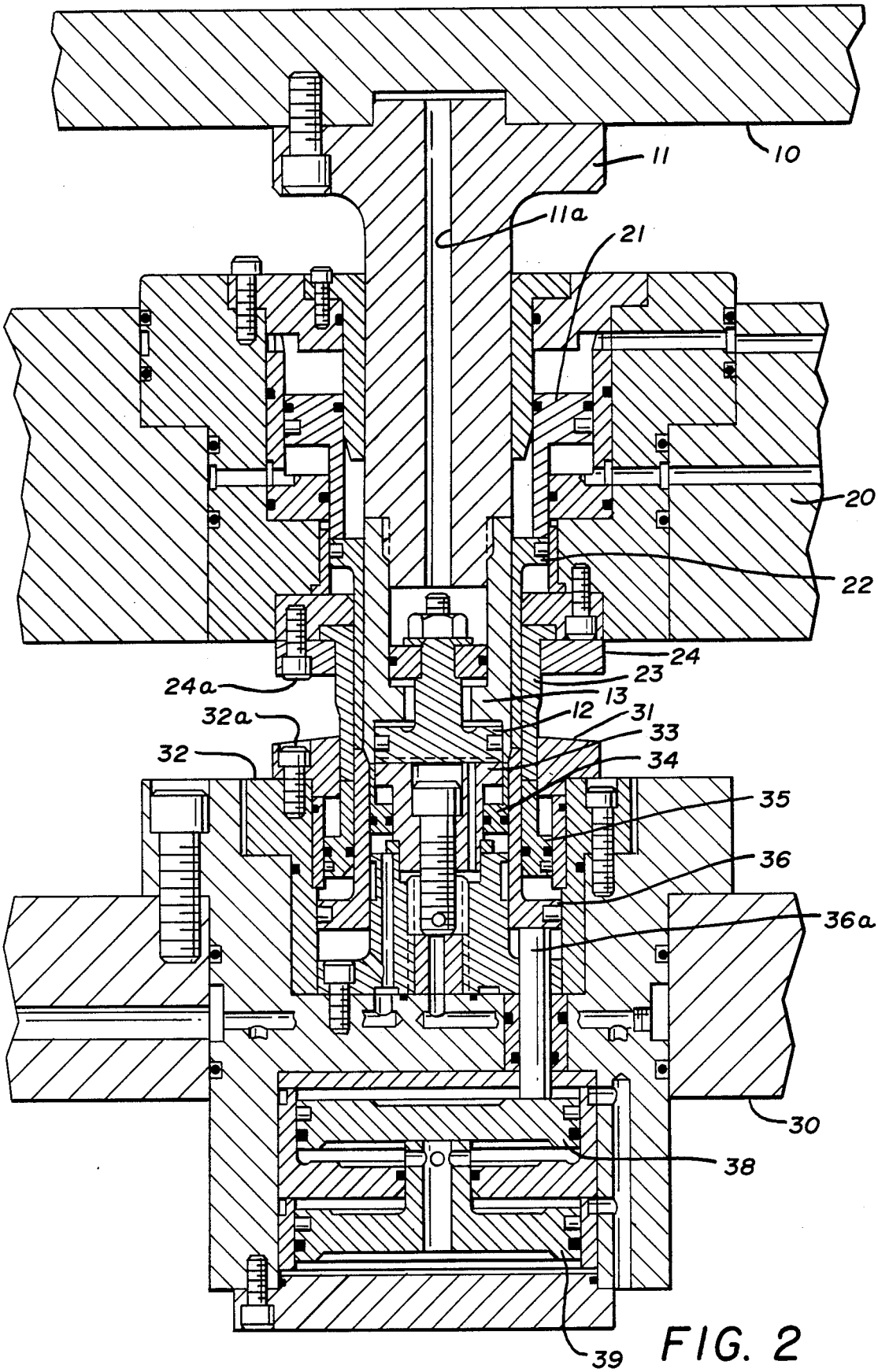
FIG. 2 is an elevational assembly view partially in section showing the position of the tooling following the second forming operation.

Referring first to FIGS. 1 and 2 of the drawings, it will be noted that the method and apparatus of the present invention is intended to be utilized in a double acting press having inner and outer slide holders 10 and 20 which are movable toward and away from a fixed base 30.

Carried on the inner slide holder 10 is a punch center post 11 which projects therefrom and is movable therewith. Secured to the distal end of the punch center post 11 is a punch core ring 13. Also carried by the center post 11 is a punch core 12 which is air loaded by pressure through passage 11*a* of the center post and which is movable within a cylinder formed by the interior of the punch core ring 13 and which is thus fluid activated for movement relatively of punch core ring 13.

The outer slide holder 20 carries an upper piston 21 and an upper pressure sleeve 22 which is disposed beneath piston 21 and around punch core ring 13 acted on by the piston 21 under fluid pressure.

Also secured to the outer slide holder 20 is a punch shell 23 secured in place by a punch shell clamp 24 and suitable screws 24*a* and which is disposed about pressure sleeve 22.

A fixed base 30 is disposed opposite slide holders 10 and 20 and includes a cut edge 31 held in place on its upper surface by a cut edge retainer 32 and suitable screws 32*a*.

The fixed base 30 also carries a die core 33 which is fixed in place and which is surrounded by a concentric knockout piston 34 which is fluid actuated.

Disposed further outboard of knockout piston 23 is a fluidly supported die core ring 36 disposed opposite or beneath pressure sleeve 22 and also disposed in concentric relationship with knockout piston 34. Finally, a fluid actuated lower pressure sleeve 35 is disposed radially further outboard of die core ring 36 and in opposite relationship with punch shell 23.

It will be noted that the die core ring 36 is supported on the post 36*a*, which is in turn supported by the fluid actuated, stacked pistons 38 and 39.

Figure 3:
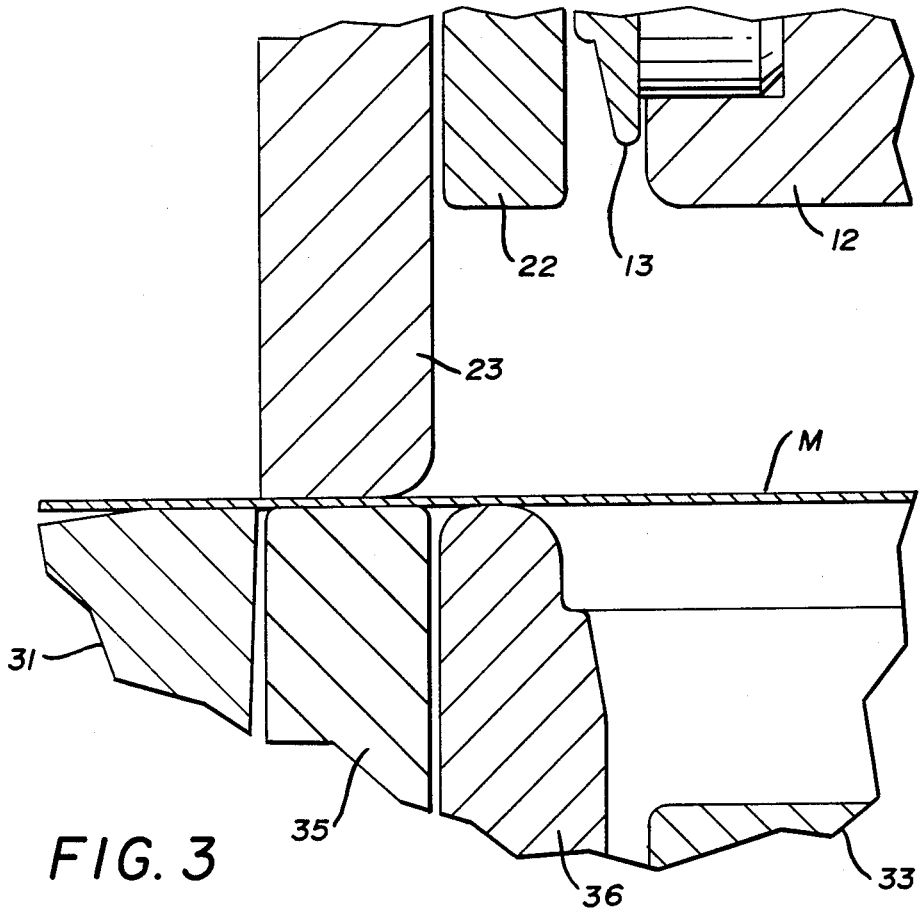
FIG. 3 is a schematic view showing the position of the relevant components of the tooling prior to the blanking operation.

Referring next to FIGS. 3 through 6 for a description of the operation of the tooling of this invention, and with particular attention first to FIG. 3, it will be noted that at the point of operation illustrated the punch shell 23 has advanced by movement of slide holder 20 to engage the material M and to clamp the material briefly against the top of the lower pressure sleeve 35. At this point the die core ring 36, which is disposed just inboard of the lower pressure sleeve 35, rests beneath the lower surface of the material M.

Figure 5:
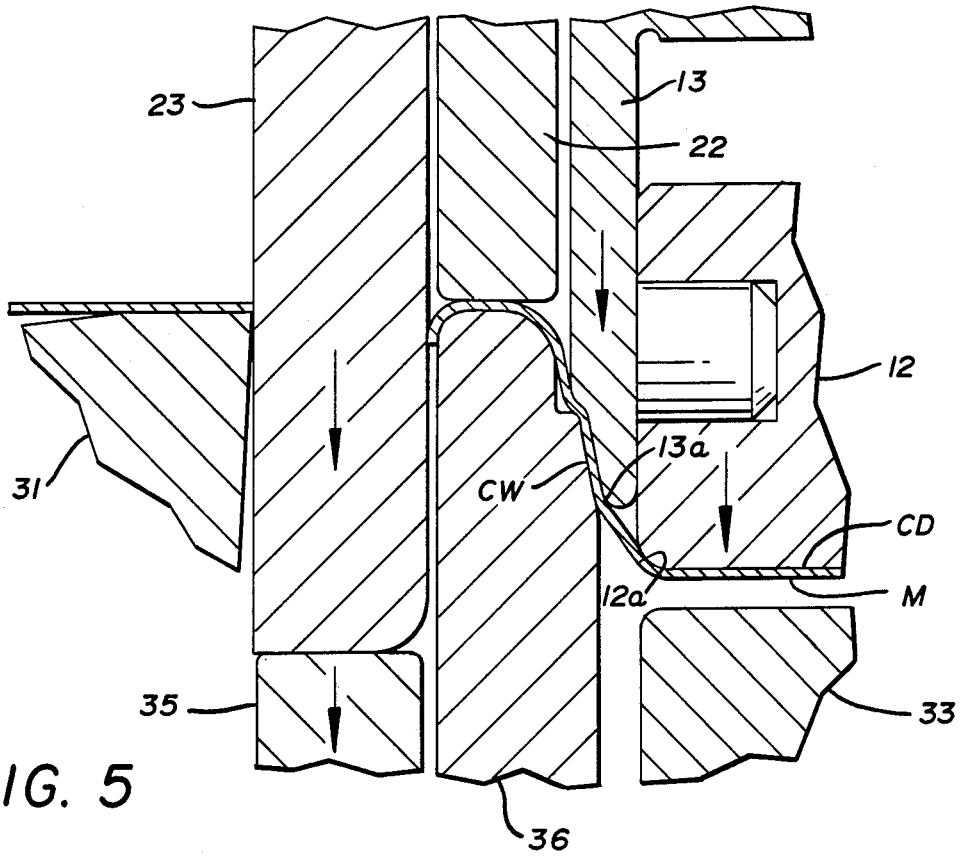
FIG. 5 is a schematic view showing relevant portions of tooling following inversion of the cut and preliminary formation of the chuckwall.

Further advancement of the inner and outer slide holders 10 and 20 will result in blanking of the material by movement of the punch shell 23 overcoming the supporting pressure beneath the lower pressure sleeve 35 to blank the material M against the cut edge 31 and to wipe the periphery thereof over the outer radius 36a of the die core ring 36 and form the material into the shape of an inverted cup still identified by the letter M as shown in FIG. 5.

The relative positions of punch core 12 and punch core ring 13 are maintained by the previously mentioned pressure on punch core 12.

At this point also, the upper pressure sleeve 22 will have been advanced so as to trap the inverted cup M between the top of the die core ring 36 and the bottom of the pressure sleeve 22 and the periphery of the inverted cup will be disposed between punch shell 23 and die core ring 36.

Figure 4:
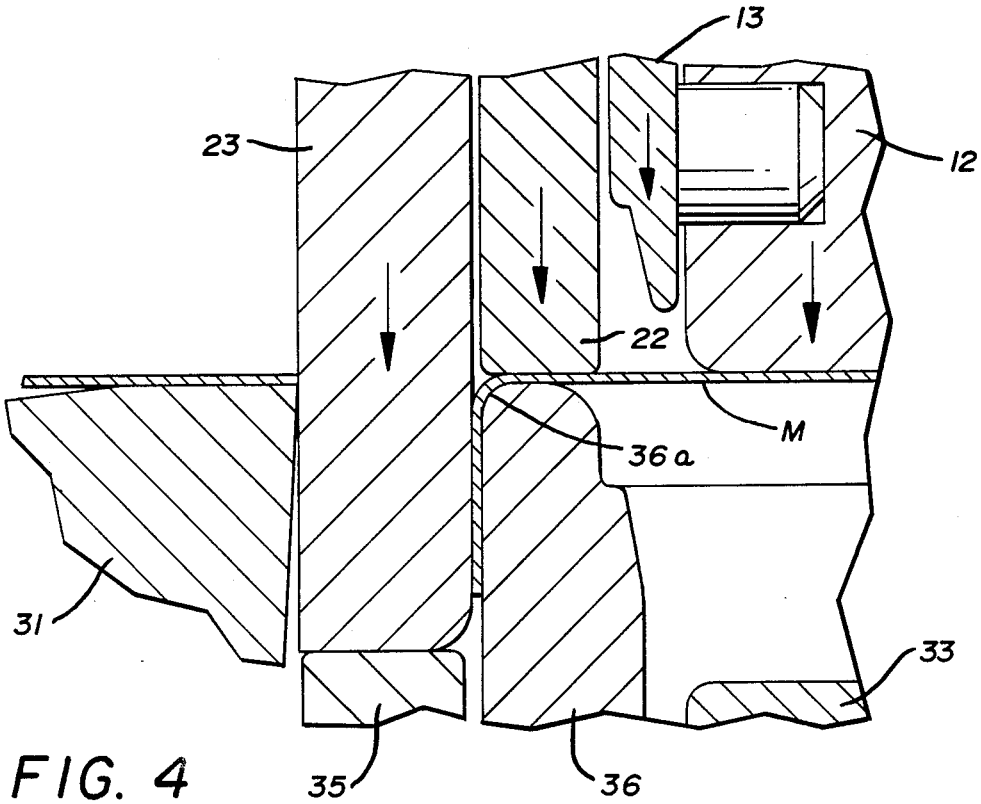
FIG. 4 is a schematic view showing the position of the relevant components of the tooling following blanking and forming of an inverted end piece.

As the slide holders 10 and 20 continue their downward movement, the tooling will advance from the position of FIG. 4 to that of FIG. 5, wherein it will be noted that the punch core ring 13 and the punch core 12 are still moving in their same relative positions and have drawn the material M, which is engaged between the sleeve 22 and the die core ring 36, so as to preliminarily form a chuckwall portion CW and a bottom center portion CD of the end pocket. Effectively the inverted cup has been reinverted in this step by pulling the material M about the top of die core ring 36 and draping it between the bottom of punch core ring 15 and punch core 12.

At this point, two radiuses are formed in the chuckwall portion. One is formed at 13*a* by the configuration of the end of the punch core ring 13 and the other is formed at the point 12*a* by the configuration of the punch core 12.

Figure 6:
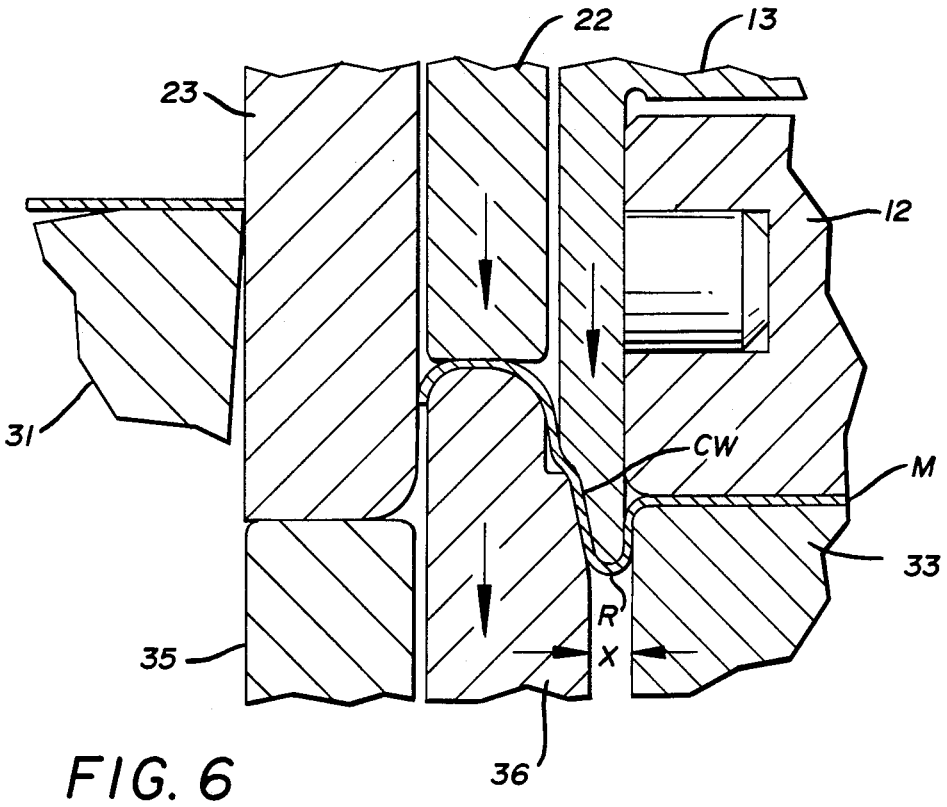
FIG. 6 is a schematic view showing the position of the relevant components of the tooling following final forming fo the chuckwall and reduction of the radius.
Figure 7:
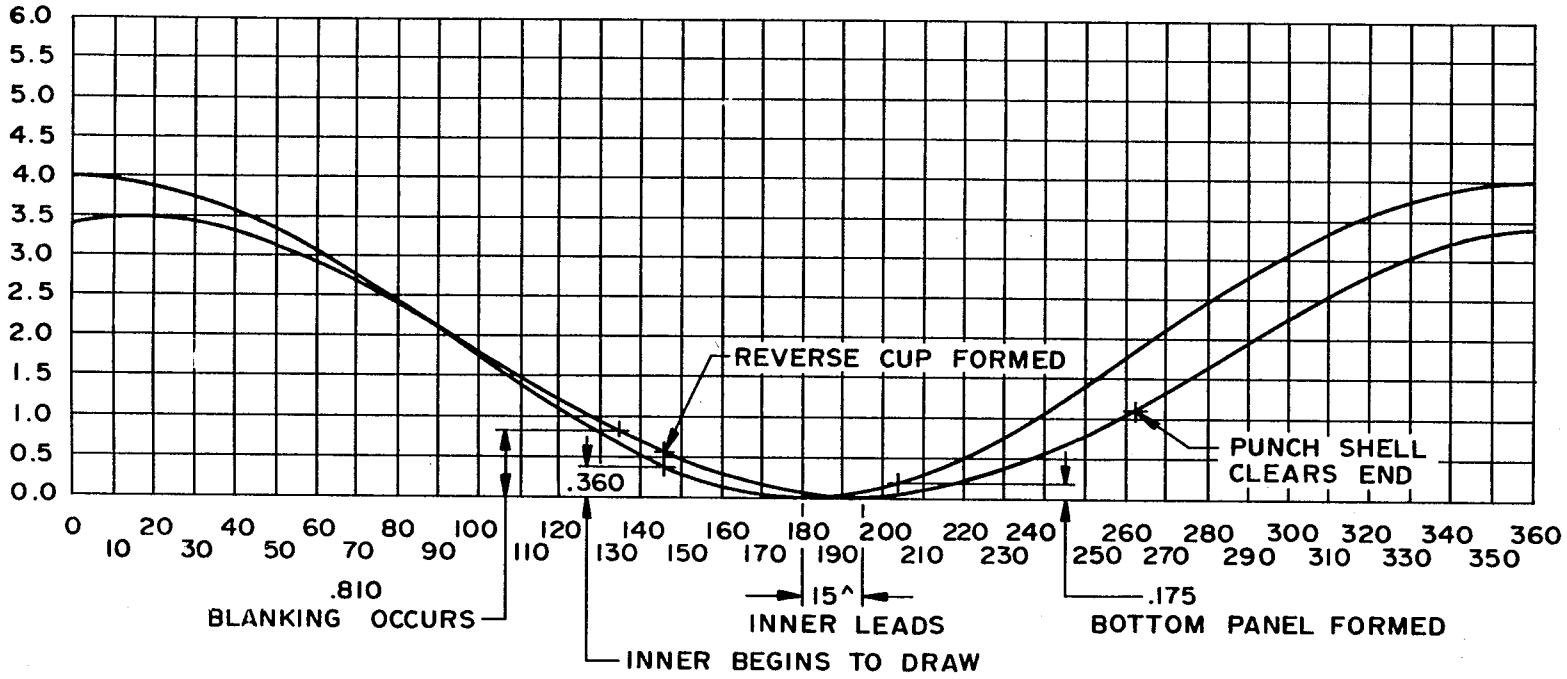
FIG. 7 is a timing diagram.

Further downward movement of the press will bring the tooling to the position of FIG. 6. At this point, it will be noted, that the punch core 12 has bottomed out on the bottom center portion CD of the material M which is trapped against the top of the die core pad 33 which is, in turn, fixed to base 30, as previously noted. Preferrably, the pressure on punch core 12 will be dropped at this point. However, the pressure sleeve 22 and the die core ring 36 have continued their downward movement as has the punch core ring 13, which is fixed to slide 10. In this fashion, the final radius R of the chuckwall has been set by the action of the punch core ring 13 and the chuckwall has been reduced in length.

Thus, as will be seen, punch core ring 13 will have moved into space X between the periphery of the die core 33 and die core ring 36, pulling the previously draped metal from chuckwall portion CW into that space and tightening radius R. This is further facilitated by the fact that pressure sleeve 22 and die core ring 36 are also moving downwardly at this time.

The result is a relatively small radius and a strengthened chuckwall, but without the usual thinning which would occur if the radius R has been formed by pulling the metal over a tool having a correspondingly sharp radius.

Following this step, activation of knockout piston 34 will raise the finished product to the die line following retraction of slides 10 and 20.

While a full and complete description of the invention has been set forth in accordance with the dictates of the patent statutes, it will be understood that modifications can be resorted to without departing from the spirit hereof or the scope of the appended claims.

What is claimed is:

1. A method of forming a container end piece from a sheet of material in a press having a fixed base and a movable platen comprising the steps of:

(a) blanking a workpiece from the sheet of material;

(b) forming an inverted cup from said workpiece by wiping its peripheral edge over a die core ring supported on the fixed platen;

(c) reversing said inverted cup by advancing a punch core and a punch core ring to form a cup having a flange area, a central body area, and a preliminary chuckwall interconnecting the flange area and the central bottom area by radiused areas with said chuckwall and chuckwall angle being formed between said punch core ring and said die core ring; and (d) maintaining engagement between said die core ring, said chuckwall and said punch core ring and advancing said punch core ring ahead of said punch core to shorten said chuckwall and reduce the radius between said chuckwall and said central bottom portion while maintaining said chuckwall angle.

2. The method of claim 1 wherein said flange of said cup formed in step c is engaged by a pressure sleeve carried by the movable platen and a die core ring carried by the fixed base; said pressure sleeve and said die core ring moving together with said punch core ring during step d.

3. A method of forming a container end piece in a press having a fixed base and a movable platen, comprising the steps of:

(a) blanking a workpiece;

(b) holding said workpiece between a pressure sleeve carried by the movable platen and a die core ring fluidly supported on the base;

(c) forming said workpiece into an inverted cup over said die core ring by advancing a punch shell carried by the movable platen;

(d) advancing a punch core and a concentric punch core ring to reverse said inverted cup and form an end piece having a preliminary chuckwall joined to a central bottom portion by an enlarged radiused portion with said central bottom portion being supported on a die core fixed to the base with said chuckwall and chuckwall angle being formed between said punch core ring and said die core ring;

(e) advancing said punch core until it bottoms on said die core;

(f) shortening said chuckwall and reducing the radius of said radiused portion by continuing the advance of said pressure sleeve and said punch core ring toward said base overcoming the fluid support of said die core ring while maintaining engagement of said chuckwall between said punch core ring and said die core ring.

4. Apparatus for forming a container end piece from a sheet of material in a press having a fixed base and a movable platen, comprising:

(a) a die core ring carried by the fixed base;

(b) a punch shell carried by the movable platen to wipe the material over the die core ring to form an inverted cup upon movement of the movable platen toward the fixed base;

(c) punch means carried by the movable platen concentrically inboard of said punch shell and telescopically receivable within said die core ring (1) whereby said punch means reverse said inverted cup and form a preliminary chuckwall and chuckwall angle upon further movement of the movable platen toward the fixed base;

(d) said punch means including:

(1) a punch core and (2) a punch core ring movable with said movable platen and relatively of said punch core still further toward said fixed base to form a final chuckwall in the cup and maintain said chuckwall angle.

5. The apparatus of claim 4 wherein a pressure sleeve is carried by the movable platen for engagement with a peripheral area of the cup following formation of said inverted cup; said pressure sleeve being movable toward the fixed base simultaneously with movement of said punch core ring relatively of said punch core.

6. Apparatus for forming a container end piece from a workpiece in a double acting press having a fixed base and inner and outer slides movable toward and away from the base, comprising:

(a) a die core fixed to the base;

(b) a die core ring fluidly supported on the base in concentric, spaced relationship with said die core;

(c) a lower pressure sleeve fluidly supported on the base in concentric relationship with said die core ring;

(d) a punch core carried by inner slide for fluidly actuated movement with respect thereto and disposed in opposed relationship with said die core;

(e) a punch core ring carried by the inner slide in concentric relationship with said punch core;

(f) an upper pressure sleeve carried by the outer slide in concentric relationship with said punch core ring and opposed relationship with said die core ring;

(g) a punch shell carried by the outer slide in concentric relationship with said upper pressure sleeve and opposed relationship with said lower pressure sleeve;

(h) said upper pressure sleeve being movable toward the base to hold the workpiece against said die core ring;

(i) said punch shell being movable toward the base to form an inverted cup by bending the periphery of the workpiece about said die core ring;

(j) said punch core and said punch core ring being movable toward the base to reverse said inverted cup and form an end piece having a preliminary chuckwall, a chuckwall angle, a central bottom panel and a radiused area between said chuckwall and said central bottom panel thereof;

(k) said punch core ring being further movable toward said base after said punch core bottoms on said die core to shorten said chuckwall while maintaining engagement therewith to maintain said chuckwall angle and reduce said radius.

* * * * *

UNITED STATES PATENT AND TRADEMARK OFFICE

CERTIFICATE OF CORRECTION

PATENT NO. : 4,716,755

DATED : January 5, 1988

INVENTOR(S) : Joseph D. Bulso, Jr. and James A. McClung

It is certified that error appears in the above-identified patent and that said Letters Patent are hereby corrected as shown below:

On the first page of the soft copy under the heading "References Cited", in the sixth entry, Pat. No. 4,109,599, delete the inventors' name, "Bulso, Jr. et al.", and substitute therefor --Schultz--.

In Column 2, Line 53, delete "cut" and substitute therefor --cup--.

In Column 3, Line 8, delete "activated" and substitute therefor --actuated--.

In Column 3, Line 25, delete the numeral "23" and substitute therefor --34--.

In Column 4, Line 3, delete "pocket" and substitute therefor --product--.

UNITED STATES PATENT AND TRADEMARK OFFICE

CERTIFICATE OF CORRECTION

PATENT NO. : 4,716,755

DATED : January 5, 1988

INVENTOR(S) : Joseph D. Bulso, Jr. and James A. McClung

It is certified that error appears in the above-identified patent and that said Letters Patent is hereby corrected as shown below:

In Column 4, Line 35, delete "has" and substitute therefor --had--.

Signed and Sealed this

Thirty-first Day of May, 1988

*Attest:*

DONALD J. QUIGG

*Attesting Officer*

*Commissioner of Patents and Trademarks*